US007699725B2

(12) United States Patent
McNamee et al.

(10) Patent No.: US 7,699,725 B2
(45) Date of Patent: Apr. 20, 2010

(54) LAYERED COMPOSITE MATERIAL BAT

(75) Inventors: Mark McNamee, Portland, OR (US); Chris S. Page, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 12/037,447

(22) Filed: Feb. 26, 2008

(65) Prior Publication Data

US 2009/0215559 A1 Aug. 27, 2009

(51) Int. Cl.
*B32B 5/12* (2006.01)
*A63B 59/06* (2006.01)

(52) U.S. Cl. ..... 473/567; 428/105; 428/107; 428/109

(58) Field of Classification Search ..... 473/567, 473/561, 319, 320, 535, 536; 428/109
See application file for complete search history.

(56) References Cited

U.S. PATENT DOCUMENTS 4,848,745 A 7/1989 Bohannan et al.
5,048,441 A 9/1991 Quigley
5,114,144 A 5/1992 Baum
5,301,940 A 4/1994 Seki et al.
5,303,917 A 4/1994 Uke
5,395,108 A 3/1995 Souders et al.
5,458,330 A 10/1995 Baum
5,460,369 A 10/1995 Baum
RE35,081 E 11/1995 Quigley
5,533,723 A 7/1996 Baum
5,624,115 A 4/1997 Baum
5,722,908 A 3/1998 Feeney et al.
5,865,696 A * 2/1999 Calapp et al. ..... 473/561
6,056,655 A 5/2000 Feeney et al.
6,152,840 A 11/2000 Baum
6,274,230 B1 8/2001 Sarrelongue et al.
6,352,485 B1 * 3/2002 Philpot et al. ..... 473/564
6,461,260 B1 10/2002 Higginbotham
6,475,580 B1 11/2002 Wright
6,497,631 B1 12/2002 Fritzke et al.
6,508,731 B1 1/2003 Feeney et al.
6,641,893 B1 * 11/2003 Suresh et al. ..... 428/105
6,733,404 B2 5/2004 Fritzke et al.
6,761,653 B1 7/2004 Higginbotham et al.
6,776,735 B1 * 8/2004 Belanger et al. ..... 473/567
6,969,330 B1 11/2005 Meeker
6,997,826 B2 * 2/2006 Sutherland ..... 473/567
7,011,588 B2 3/2006 Fritzke et al.
7,033,291 B1 4/2006 Meeker
7,214,152 B1 5/2007 Vacek et al.
2004/0029660 A1 2/2004 Chen et al.

(Continued)

*Primary Examiner*—Mark S Graham
(74) *Attorney, Agent, or Firm*—Plumsea Law Group, LLC

(57) ABSTRACT

A layered composite bat is designed to include fiber angles of orientation that are layered and progressive. The bat includes a multi-layered composite material configuration wherein progressing from an innermost layer to an outermost layer, the unidirectional fiber angle of orientation within each layer increases from an angle substantially parallel to the longitudinal axis of the bat to an angle substantially perpendicular to the longitudinal axis of the bat. In progressing from an innermost layer to an outermost layer, there also exists at least one instance where subsequent positive angles of orientation are separated by or vary by about 15 degrees. The bat may include multiple walls. Each wall contains layers that progress from a low angle to a high angle in 15-degree increments.

11 Claims, 8 Drawing Sheets

U.S. PATENT DOCUMENTS

2004/0209716 A1 10/2004 Vacek et al.
2006/0025249 A1 2/2006 Giannetti et al.
2006/0025253 A1 2/2006 Giannetti et al.
2007/0202974 A1* 8/2007 Giannetti ..... 473/564

* cited by examiner

LAYERED COMPOSITE MATERIAL BAT

BACKGROUND OF THE INVENTION

1. Field of the Invention

The present invention relates generally to a composite material bat. More specifically, the bat includes a shell made of multiple layers of unidirectional fiber, wherein the orientation of the fibers increases from a low angle to a high angle from the interior of the shell to the exterior of the shell.

2. Description of Related Art

Diamond sports, such as baseball and softball, typically use bats made of various materials and configurations. Depending on such factors including the regulations of a sport and the gender and age of the players, the size, weight, or dimensions of a bat may also vary. In developing a bat, design considerations include longitudinal stiffness, moment of inertia, mass, and center of gravity. Common materials for bats include wood, plastics, metals, and composites.

Solid wood bats are traditionally used in baseball. Due to impact forces, wood bats are prone to cracking. The wood bats used in baseball are typically constructed of white ash or maple. Wood bats may also be made of hickory and bamboo. Wood bats have become increasingly expensive, causing some baseball leagues to turn to alternative material bats.

Plastic bats are more often used by very young children. For example, plastic bats are used when playing whiffle ball. Plastic bats are designed to withstand the smaller forces exerted by smaller individuals and less rigid, slower moving balls.

Metal bats are typically hollow, tubular, thin-walled shells composed of aluminum or titanium. Metal bats are most commonly used by baseball youth leagues and in fast pitch and slow pitch softball. Metal bats have a tendency to deform in the impact zones due to their thin-walled structure. Once a metal bat is deformed, the trajectory of a ball coming in contact with the bat becomes unpredictable and the bat is typically discarded.

Composite materials can be expensive. Composite materials or composites are materials made from two or more individual materials. When combined, the individual materials retain their own properties. However, the overall composite assumes some combination of the properties of both materials.

Composite materials may be formed of fibers embedded in a matrix. For example, a unidirectional carbon fiber resin matrix composite material is made of carbon fibers embedded within an epoxy resin matrix. The carbon fibers have a high toughness and are typically brittle. The toughness of a material refers to the ability of that material to resist fracture. The brittleness or ductility of a material refers to the tendency of that material to deform prior to fracture. The more brittle a material, the less that material deforms prior to fracture. The more ductile a material, the more that material deforms prior to fracture. Most matrix materials tend to be ductile but not very tough. However, when the epoxy resin and carbon fibers are combined, the composite material may assume an adequate toughness and ductility for use in high impact equipment.

Composite material bats are most commonly used in college softball. Of the materials typically used to construct bats, composite materials allow for the most design flexibility and customization. In other words, longitudinal stiffness, moment of inertia, mass, and center of gravity may be more precisely controlled using such design factors as type of matrix material, type and modulus of the fibers, orientation of the fibers, and number of layers or thickness of the composite.

Composite materials may be isotropic or orthotropic in nature. Isotropic materials have material properties that are independent of the direction of an applied force. In other words, a material property, such as toughness, does not vary if a force is applied longitudinally or axially. Orthotropic materials have material properties that are dependent on the direction of an applied force. Composite materials are typically orthotropic. In other words, a material property, such as toughness, is dependent on the orientation of an applied force. Composite materials having unidirectional fibers embedded in a matrix are orthotropic.

Impact with balls typically cause composite material bats to fail by cracking or breaking. To inhibit failure in composite material devices, manufacturers have taken various approaches. One example is U.S. Pat. No. 5,395,108 to Souders et al. that teaches a layered fiber-reinforced composite material bat made of pre-impregnated ("prepreg") material. The composite material of the Souders bat includes a braided base layer and additional unidirectional fiber layers that alternate between +/−30 degrees and +/−45 degrees. The braided base layer is composed of fibers that are oriented at 0 degrees and 90 degrees. The additional unidirectional fiber layers alternate in the following manner: +30 degrees, −30 degrees, +45 degrees, −45 degrees, +30 degrees, −30 degrees, +45 degrees, −45 degrees. Each +/−layer combination is a ply, and the bat of Souders et al. uses as many as eight plies.

A second example is U.S. Pat. No. 5,533,723 to Baum that teaches a layered composite material bat including a first sock, a second sock, and an exterior layer made of wood veneer planks. The first sock is comprised of a first layer made of Dupont Kevlar® or S-2 glass fiber with fibers aligned along the longitudinal axis of the bat. The second layer made of graphite is comprised of fibers aligned at a 90 degree angle to the longitudinal axis of the bat. The third and fourth layers are comprised of fibers arrayed at 45 degrees to the fibers of the first two layers. The second sock is constructed similarly to the first sock. However, the second sock includes an additional fiberglass layer with fibers aligned at a 90 degree angle to the longitudinal axis of the bat.

A third example is U.S. Pat. No. RE35081 to Quigley that teaches a layered composite member, such as a sail mast, with high bending strength. The Quigley apparatus includes an innermost ply with unidirectional strands that may be oriented anywhere between +/−30 degrees and +/−90 degrees. A second, adjacent ply has two sets of fibers that are oriented axially along the circumference of the member. The first set of fibers comprises multiple, unbraided, and continuous strips. The second set of fibers comprises multiple braided strips. The second ply is composed of alternating strips of the first and second sets of fibers. Third, fourth, and fifth plies are constructed similarly to the second ply. However, third and fifth plies have fibers that are helically oriented at an angle between +/−5 degrees and +/−60 degrees along the circumference of the member. Similar to the second ply, the fourth ply is axially oriented along the circumference of the member. A final ply of similar construction and fiber orientation as the innermost ply is then applied.

A fourth example is U.S. Pat. No. 6,475,580 to Wright that teaches a method of manufacturing an elongate article such as a golf club shaft. The elongate article is composed of multiple layers of a prepreg composite material. The inner, outer, and interior layers have unidirectional fibers that are aligned with the longitudinal axis of the elongate article. Additional interior layers also have unidirectional fibers oriented between +/−25 and +/−45 degrees with respect to the longitudinal axis of the article.

While the art has addressed many issues related to strength and bending, the challenges of a thick-walled composite shell experiencing repeated impact forces remains unaddressed. In composite material bats, the impact of a ball with the bat tends to cause compression forces on the outermost layers of the bat that shift to tensile forces on the innermost layers of the bat. As a result, many composite bats tend to fail around the edges of the impact zone because the bat is not designed to withstand both compressive and tensile forces. Alternatively, some composite bats may use braided layers, which may be difficult and expensive to manufacture. The use of braided layers may also undesirably increase the weight of the bat.

Therefore, there exists a need in the art for a composite material bat capable of withstanding exterior compressive forces and interior tensile forces to increase durability while effectively managing weight and manufacturing costs.

SUMMARY OF THE INVENTION

A layered composite material bat with a shell made of multiple layers of unidirectional fiber is disclosed.

In one aspect, the bat comprises a hollow barrel associated with a handle, a wall of the barrel comprising a plurality of layers of composite material, an innermost layer of the wall comprising a first plurality of unidirectional fibers positioned at a low angle with respect to a longitudinal axis of the bat, an outer layer of the wall comprising a second plurality of unidirectional fibers positioned at a high angle with respect to the longitudinal axis of the bat, and a series of layers positioned between the innermost layer and the outer layer, wherein each layer in the series of layers includes unidirectional fibers, and wherein the orientation angles of the unidirectional fibers in two successive layers of the series progress by about 15 degrees.

In another aspect, the low angle ranges from about 0 degrees to about 30 degrees.

In another aspect, the high angle ranges from about 45 degrees to about 90 degrees.

In another aspect, each layer in the series of layers comprises a plus-minus unit.

In another aspect, an outermost layer is positioned exterior of the outer layer.

In another aspect, the outermost layer comprises glass fiber.

In another aspect, the outermost layer comprises a coating layer.

In another aspect, the bat further comprises a second wall of the barrel comprising a second plurality of layers of composite material, wherein at least a portion of the second wall is configured to move with respect to the first wall.

In another aspect, the first wall and the second wall are separated by a layer of release film.

In another aspect, the invention provides a bat comprising a hollow barrel having a first wall and a concentric second wall, a first wall innermost layer having unidirectional fibers positioned at a first low angle with respect to the longitudinal axis of the bat, a first wall outer layer having unidirectional fibers positioned at a first high angle with respect to the longitudinal axis of the bat, a first wall series of layers positioned between the first wall innermost layer and the first wall outer layer, wherein each layer in the first wall series of layers includes unidirectional fibers at angles different from the first low angle and the first high angle, and wherein the angles of the unidirectional fibers in two successive layers of the first wall series progress by about 15 degrees, a second wall innermost layer having unidirectional fibers positioned at a second low angle with respect to the longitudinal axis of the bat, a second wall outer layer having unidirectional fibers positioned at a second high angle with respect to the longitudinal axis of the bat, and a second wall series of layers positioned between the second wall innermost layer and the second wall outer layer, wherein each layer in the second wall series of layers includes unidirectional fibers at angles different from the second low angle and the second high angle, and wherein the angles of the unidirectional fibers in two successive layers of the second wall series progress by about 15 degrees.

In another aspect, the first low angle and the second low angle range from about 0 degrees to about 30 degrees.

In another aspect, the first high angle and the second high angle range from about 45 to about 90 degrees.

In another aspect, the first wall is configured to move with respect to at least a portion of the second wall.

In another aspect, a layer of release film is positioned between the first wall and the second wall.

In another aspect, the barrel is configured to be attached to a handle.

In another aspect, the invention provides a composite material shell comprising an innermost layer including a first plurality of unidirectional fibers oriented at a first angle with respect to a longitudinal axis of the shell, an exterior layer including a second plurality of unidirectional fibers oriented at a second angle with respect to the longitudinal axis of the shell, a third layer positioned between the innermost layer and the exterior layer, the third layer including a third plurality of unidirectional fibers oriented at a third angle with respect to the longitudinal axis of the shell, a fourth layer positioned between the third layer and the exterior layer, the fourth layer including a fourth plurality of unidirectional fibers oriented at a fourth angle with respect to the longitudinal axis of the shell, wherein the first angle is a low angle and the second angle is a high angle, wherein the fourth angle is less than the second angle, and wherein the fourth angle is about 15 degrees greater than the third angle.

In another aspect, the low angle ranges from about zero degrees to about thirty degrees.

In another aspect, the high angle ranges from about 45 degrees to about 90 degrees.

In another aspect, the third angle is about 15 degrees greater than the first angle.

In another aspect, the shell is configured to be a barrel portion of a bat.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Embodiments of the present invention include a multi-layered composite material bat, wherein the unidirectional fiber angle of orientation within each layer ascends or increases from an angle substantially parallel to the longitudinal axis of the bat on inner layers of the shell of the barrel to higher angles on outer layers of the shell of the barrel. In progressing from an innermost layer to an exterior layer, subsequent positive angles of orientation are separated by about 15 degrees. A layered and progressive approach of fiber angle orientations provides greater fiber density and coverage to increase durability while effectively managing weight. Further, axially oriented fibers on the inner layers are better suited to withstand impact tensile forces while fibers having a more circumferential orientation are better suited to withstand impact compression forces.

Figure 1:
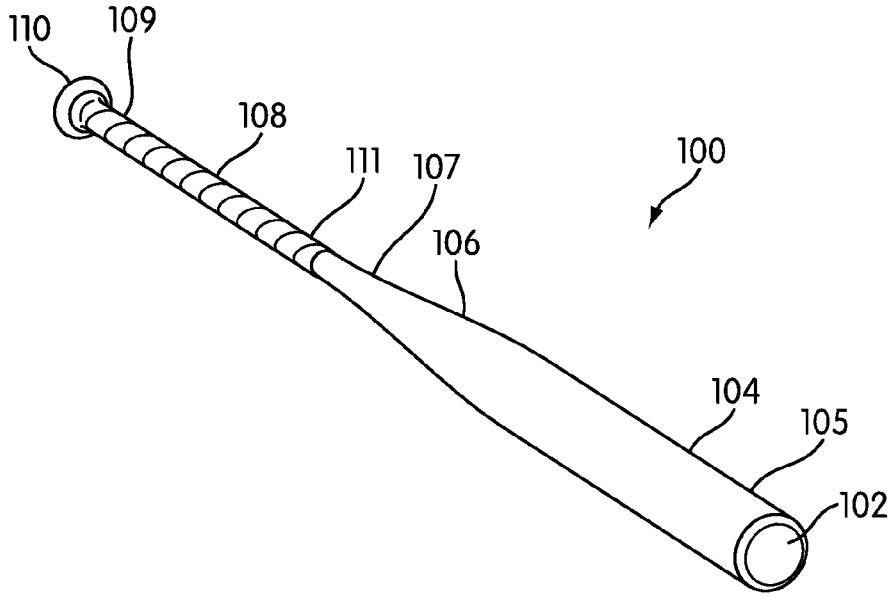
FIG. 1 is a schematic isometric view of an embodiment of a composite material bat.
Figure 2:
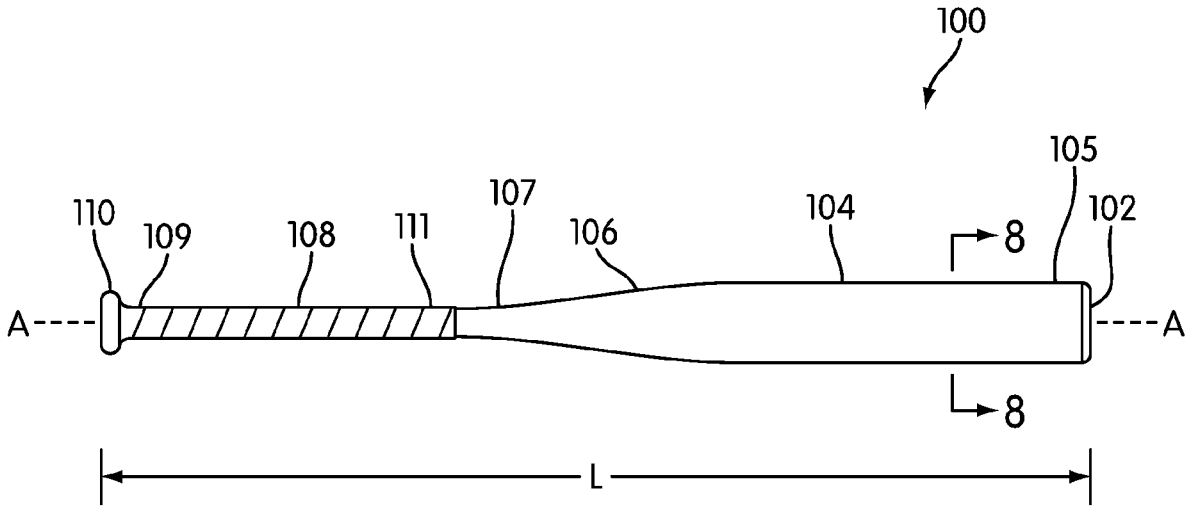
FIG. 2 is a schematic plan view of an embodiment of a composite material bat.

FIG. 1 is a schematic isometric view of an embodiment of a composite material bat. FIG. 2 is a schematic plan view of an embodiment of a composite material bat. Referring to FIGS. 1 and 2, a typical composite material bat 100 may be of a length L. Composite material bat 100 may include a cap 102 that is associated with barrel portion 104 at barrel portion first end 105. Barrel portion second end 107 is associated with handle portion 108 at handle portion second end 111. Barrel portion 104 may include a tapered region 106. Handle portion first end 109 may include a base or knob 110. Axis A represents the longitudinal axis of composite material bat 100.

Barrel portion 104 may be the hitting region of composite material bat 100. Ideally, when a batter swings the bat, barrel portion 104 makes contact with the ball. Barrel portion 104, including tapered region 106, is configured to efficiently rebound the ball away from the bat and withstand repeated impacts. In different embodiments, the size and shape of barrel portion 104 may vary.

The size and shape of barrel portion 104 may be any size and shape. However, in some embodiments, the size and shape are selected to allow the greatest energy transfer from composite material bat 100 to ball and the least vibratory transfer from composite material bat 100 to the user. In many instances, the actual size and shape may be prescribed by the regulatory organizations that oversee organized sports. Such regulatory organizations may include the National Collegiate Athletic Association (NCAA) or national organizations that participate in contests run by the International Olympic Committee (IOC). In some embodiments, barrel portion 104 may be generally cylindrical in shape and have a tapered region 106 that may be generally frustoconical in shape. Barrel portion 104 may, in some embodiments, be two-thirds the length L of composite material bat 100. The diameter of tapered region 106 may be substantially similar to the diameter of barrel portion first end 107 so that tapered region 106 may be smoothly connected to barrel portion first end 107. Tapered region 106 then gradually decreases in diameter to approximately the same diameter as handle portion second end 111 so that tapered region 106 may be smoothly associated with handle portion second end 111.

In addition, barrel portion 104 may be constructed with one or more walls. Typically, the number of walls varies from one to three. Each wall may be constructed of multiple layers of composite material. Each wall may also be separated from other walls by a layer of material placed between two walls to prevent the walls from bonding to each other. A commonly used material is release film, which is a thin layer of plastic that has been treated so as not to bond to the matrix or fiber materials. The walls may only be bonded at tapered region 106 and at cap 102.

The composite material layers of barrel portion 104 are, in some embodiments, formed into a thin or thick-walled shell. The interior of the shell of barrel portion 104 may be filled or left hollow. Various types of foam are commonly used to fill a composite material bat interior. Additionally, stiffening inserts, such as metal, plastic, or composite material inserts, may be disposed within barrel portion 104. Such inserts may be sized and dimensioned to fit snugly within barrel portion 104, and may even be fixedly attached to an interior surface of barrel portion 104, so that repeated impacts with balls do not dislodge the inserts. Such fixed attachment could be achieved using adhesives, co-forming, or by welding.

Bats used in diamond sports are typically designed to be durable because of the often large impact forces experienced by the bat when the bat contacts a ball. The impact of the ball on the bat creates tensile, compression, and shear stresses on the bat. Tensile stresses refer to forces that pull on a body so as to produce an elongation. Compression stresses refer to forces that push on a body to reduce its length. Shear stresses refer to forces that are parallel or tangential to a face of a body. Shear stresses occur near at the area where the bat meets the ball and between the walls of a bat.

Figure 3:
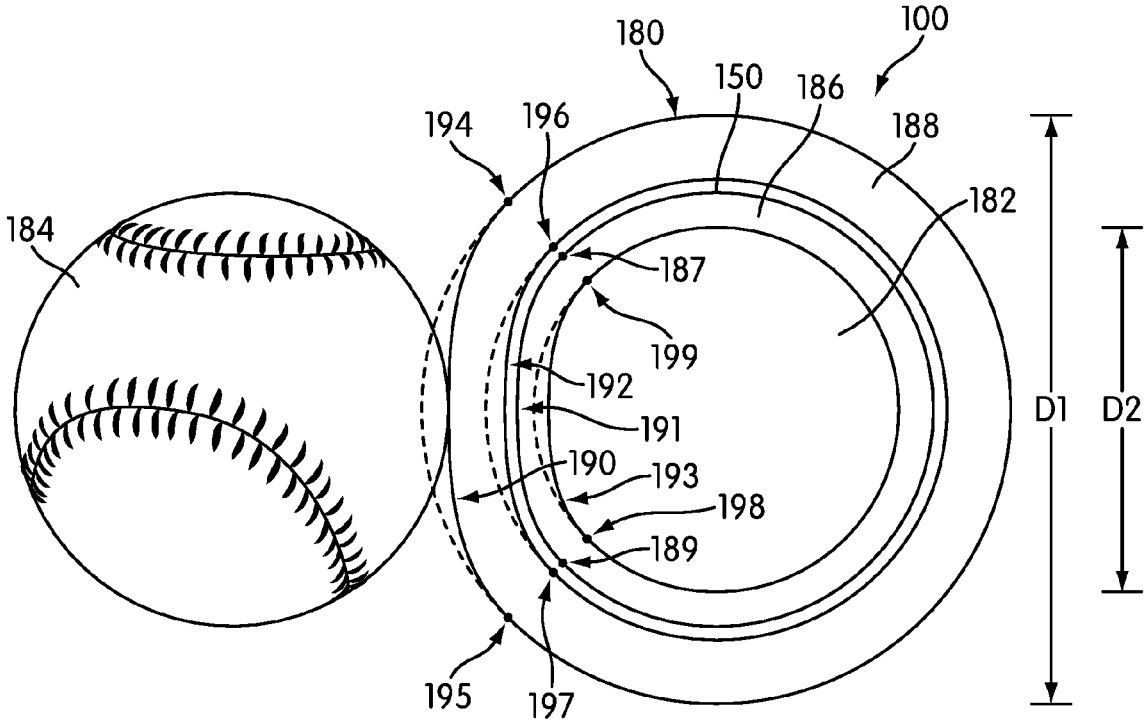
FIG. 3 is a schematic diagram of the effect the impact of a baseball has on a composite material bat.

The stresses may result in a radial hoop deformation along the cylindrically shaped barrel, a bending deformation near the region where the bat is held, and a local deformation at the impact site. FIG. 3 is a schematic diagram of the local deformation the impact of a baseball may have on the shell of a barrel portion of a composite material bat. Referring to FIG. 3, composite material bat 100 is a two-walled bat including first wall 186 and second wall 188. Release film 150 may be located between first wall 186 and second wall 188. The thickness of release film 150 has been exaggerated in FIG. 3 so that composite bat 100 can be more easily described. In this embodiment, composite material bat exterior 180 is defined by the exterior of first wall 186 and composite material bat interior 182 is hollow.

When baseball 184 contacts composite material bat 100, both baseball 184 and composite material bat 100 may resiliently deform. In order to simplify the discussion, baseball 184 has not been shown in a deformed state. The deformations are created by the force of the ball on the bat and the bat on the ball. The force of the ball on the bat may be dependent on the force with which the ball was thrown and the material properties of the ball. The force of the bat on the ball may be dependent on the swing speed of the bat, the location of the point of contact on the length and/or circumference of the bat, and the material properties of the bat.

The deformed areas or impact zones 190, 192, and 191 are regions of composite material bat 100 where the composite material layers are forced inward toward interior 182. Each impact zone 190, 191, and 192 include boundaries where the deforming material meets material of the bat that does not deform. The boundaries of impact zone 190, located in first wall 186, are indicated by reference points 194, 195, 196, and 197. The boundaries of impact zone 192, located in release film layer 150, are indicated by reference points 196, 197, 187, and 189. The boundaries of impact zone 191, located in second wall 188, are indicated by reference points 197, 189, 198, and 199.

After initial contact between baseball 184 and composite material bat 100, impact zones 190, 192, and 191 are created. A portion of the kinetic energy of the pitched ball and swung bat is converted to potential energy stored in the impact. Some portion of the potential energy is lost as a result of friction, vibrations, or otherwise absorbed by baseball 184 and composite material bat 100 due to their respective material properties. However, the remaining potential energy is converted to kinetic energy to propel baseball 184 away from composite material bat 100. The less energy that is lost during impact the further the ball may be propelled from the bat.

Generally, bats are at least partially designed to maximize the conversion of potential energy kinetic energy while maintaining the durability of the bat. This tradeoff may be expressed as a balance between bat stiffness and energy transfer. Typically, bats have an axial stiffness and a longitudinal stiffness. Longitudinal stiffness resists bending on impact, and axial stiffness reduces local deformation at the impact site. The axial stiffness and longitudinal stiffness of a composite material bat may depend on the orientation of fibers within each layer of the bat as well as other factors such as the type, modulus, and density of the fibers and the type of matrix material.

Fibers that are oriented at a 0 degree angle with respect to a longitudinal axis of a composite bat, referred to herein as "longitudinal fibers", tend to provide greater longitudinal stiffness to the bat than fibers that are oriented at a 90 degree angle with respect to a longitudinal axis, referred to herein as "axial fibers". However, axial fibers tend to provide greater axial stiffness to the bat than longitudinal fibers. Fibers at angles other then 0 and 90 degrees to the longitudinal axis provide some stiffness in the longitudinal direction and some stiffness in the axial direction.

Typically, a bat may also be designed to withstand the magnitude and types of stresses that are common at impact. Upon impact, the exterior of composite material bat 100 primarily experiences compression stresses while the interior surface of composite material bat 100 primarily experiences tension stresses. These different stresses are due in part to the thickness of the shell of the bat. The type of stress, compression or tension, may vary through the thickness of the shell, so that outer layers of the shell may tend to experience more compression than tension and the inner layers of the shell may tend to experience more tension than compression.

Additionally, a force applied to an exterior of a hoop or shell-shaped object tends to create stresses that are greater at the interior of the shell than at the exterior of the shell. Therefore, the stress at the interior surface of composite material bat 100 may generally be greater than the stress at the exterior surface of composite bat 100. A force, such as a baseball 184 thrown at a high speed, may produce a tension stress greater than composite material bat 100 can withstand. As a result, composite material bat 100 may fail. In other words, composite material bat 100 may crack or break. Failure is more likely to occur initially at points 198 and 199 within the interior of composite material bat 100.

In order to address the stresses experienced by composite material bat 100 and the issue of failure, a layered and progressive approach of fiber angle orientations providing greater fiber density and coverage is proposed. Longitudinal fibers may provide greater resistance to tensile stress than axial fibers. However, axial fibers may provide greater resistance to compression stress than longitudinal fibers. Therefore, in some embodiments, longitudinal fiber layers are disposed on or near an inner surface of barrel portion 104. Additionally, in some embodiments, axial fibers are disposed on or hear an exterior surface of barrel portion 104.

Increasing the angular increment of subsequent layers by approximately 15 degrees provides greater coverage, and as a result increases the overall durability of composite material bat 100. In other words, as the weave becomes tighter, the composite material bat becomes more durable. Additionally, as the stresses are shifting from tension stresses on the interior of the shell of barrel portion 104 to compression stresses on the exterior of the shell of barrel portion 104, the progressive increase of the angle of the fibers in the layers of the shell of barrel portion 104 from longitudinal fibers on or near the interior to or towards axial fibers on or near the exterior may accommodate these shifting stresses.

Composite material bat 100 may incorporate a number of materials and configurations to create the flexibility and energy transfer required for a high performance bat. For example, composite material bat 100 may include numerous layers that provide strength to the bat in a different regions or planes.

In some embodiments, the composite material bat may be comprised of multiple layers of composite material. Each layer may have unidirectional fibers oriented at varying angles with respect to the longitudinal axis of the composite material bat. In progressing from an innermost layer to an exterior layer of the shell of barrel portion 104, the unidirectional fiber angle of orientation within each layer ascends or increases from low angles, angles substantially parallel to or within 30 degrees of the longitudinal axis of the bat, toward higher angles, angles substantially perpendicular to the longitudinal axis or within 45 degrees of a line normal to the longitudinal axis of the bat. In progressing from an innermost layer to an exterior layer, in some embodiments, subsequent positive angles of orientation of fibers of two layers are separated by about 15 degrees.

In measuring the angles of the fibers of a layer, a positive measurement direction (+) from the longitudinal axis may be defined. The angles of the fibers of any particular layer may be either negative or positive with respect to the longitudinal axis of the bat so that no angle is given a measurement greater than 90 degrees. For example, a layer may have fibers positioned at a +30 degree angle with respect to longitudinal axis A. Another layer may have fibers positioned orthogonally to the +30 degree fibers, or at a +150 degree angle with respect to longitudinal axis A, but that angle is referred to as −30.

Often, the negative and positive values of an angle are utilized in subsequent layers. The aforementioned assembly may be referred to as a plus-minus layer combination. For example, if a layer of composite material having a +45 degree unidirectional fiber angle of orientation is used, a corresponding −45 degree unidirectional fiber angle of orientation may also be used in a subsequent layer. The assembly may be referred to as a plus-minus 45 degree layer combination. In addition, subsequent plus-minus layer combinations, i.e., plus-minus layer combinations closer to the exterior of the shell of barrel portion 104, may include fiber angles of orientation that may be staggered by approximately +15 degrees. For example, a plus-minus 45 degree layer combination may be followed by a plus-minus 60 degree layer combination. Although 15 degrees may be selected, in other embodiments, other angles may be provided. For example, due to manufacturing and quality control constraints, a "15 degree" unidirectional fiber angle change may be any shift from 10 to 20 degrees. Additionally, improvements in manufacturing techniques may allow for smaller incremental angles, such as 1-14 degrees.

Alternatively, the layering process may be described in terms of the mathematical concept of absolute values. Absolute value is generally defined as the numerical value of a number without regard to its sign. In other words, the positive or negative directionality is ignored. For example, the absolute value of a +45 degree angle is 45 degrees, and the absolute value of a −45 degree angle is also 45 degrees. In an embodiment of a composite bat with progressively changing unidirectional fiber angles, the absolute value of the angle of unidirectional fibers within each layer of a plurality of layers of the shall progresses from an angle about 0 degrees with respect to the longitudinal axis of the bat on an innermost layer to a larger angle of about 60-90 degrees with respect to the longitudinal axis of the bat on an outermost layer.

The absolute value the unidirectional fiber angles of orientation increase up to a maximum absolute value of 90 degrees. The absolute values of the fiber angles of orientation include 0, 15, 30, 45, 60, 75, and 90 degrees. In addition, the difference in the absolute values of fiber angle orientations of at least two subsequent layers is equal to or about 15 degrees.

Figure 4:
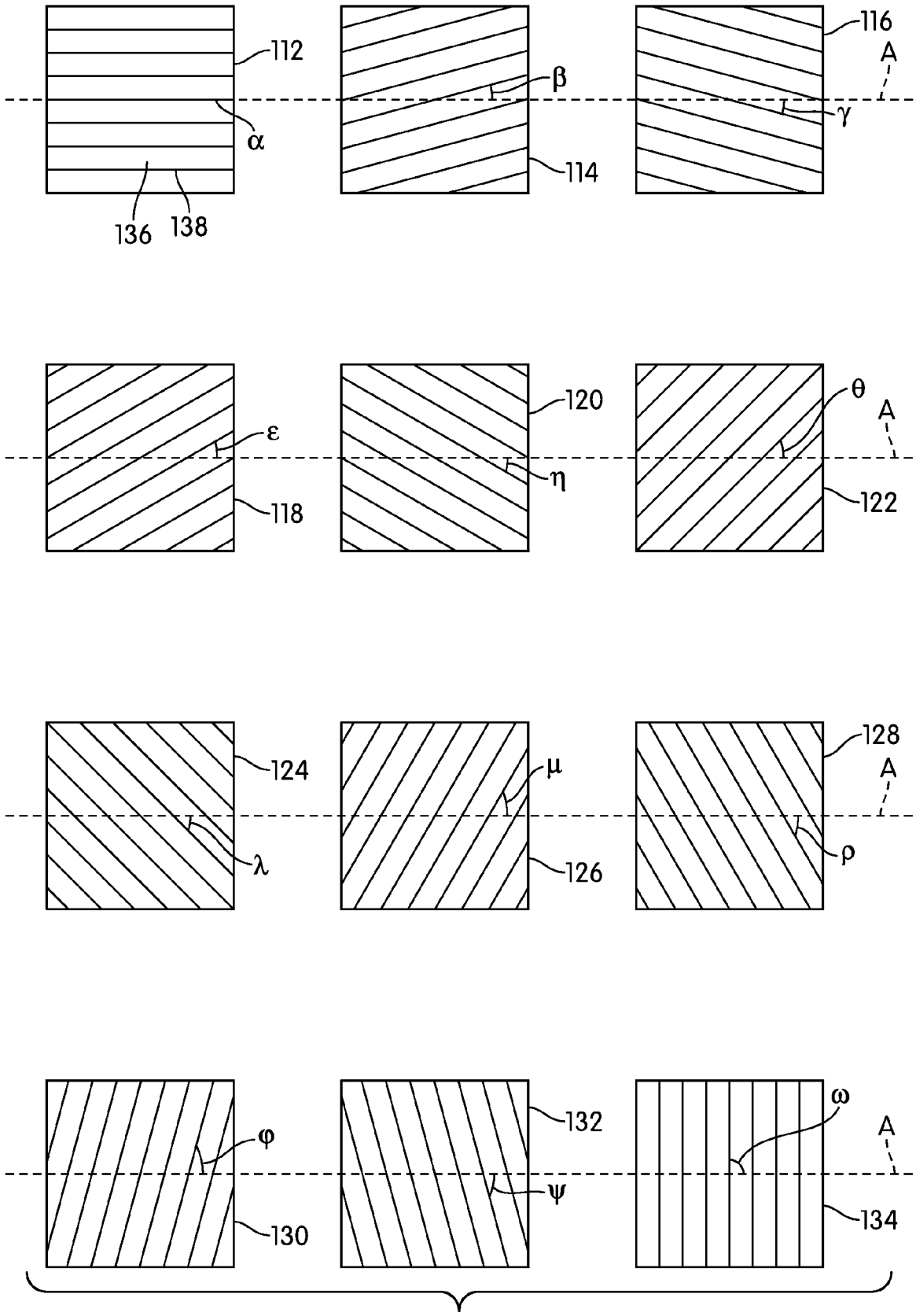
FIG. 4 is a schematic diagram of numerous embodiments of composite material layers having varying fiber orientations.

FIG. 4 is a schematic diagram of numerous embodiments of composite layers having varying fiber orientations that may be used in embodiments of composite material bat 100. Referring to FIG. 4, matrix 136 and fibers 138 constitute the components of each composite layer illustrated. The composition of matrix 136 may be any matrix material typically used in composite materials. In some embodiments, matrix 136 is an epoxy resin. However, in other embodiments, matrix 136 may be any matrix material known in the art, such as thermoplastic or thermoset polymers. Thermoplastic polymers include ABS, nylon, polyether, and polypropylene. Thermoset polymers include epoxy, polyester, and polyurethane.

The composition of fibers 138 may be any material typically used in composite materials. In some embodiments, fibers 138 are carbon fibers. However, in other embodiments, fibers 138 may be made of another material that is typically used in composite materials, such as glass, metal, aramids, or other natural or synthetic materials. The fibers may be chopped fibers, where each fiber has a relatively short length, or continuous, where each fiber has a length approximately the same as the length of the ply. The fibers may be dry fiber or pre impregnated or "prepreg" fibers. Each fiber has a thickness or modulus, and the fibers used in barrel portion 104 may have any fiber modulus known in the art. In different embodiments, the size, spacing, and orientation of fibers 138 may vary. The size or diameter of a single fiber of fibers 138 and the spacing or distance between adjacent fibers 138 may be a function of the material strength required. In some embodiments, the diameter of a single fiber of fibers 138 is the smallest diameter that may be manufactured. The diameter of the fiber may dictate the thickness of a single layer of composite material and therefore, dictate the weight. In an embodiment, the distance between fibers may be five times the diameter of a single fiber. However, in other embodiments, the size and spacing may be different to increase or decrease strength or weight.

Preferably, fibers 138 are unidirectional prepreg fibers 138. Unidirectional means fibers 138 are substantially parallel to each other. It is also preferable that fibers 138 are monofilaments. Fibers 138 of any individual layer are preferably not braided, weaved, or otherwise combined with other fibers 138 of that or any other layer within matrix 136.

In discussing angles and orientations, the terms "approximately" and "about" are often used. These terms are used because manufacturing processes may produce composite material bats 100 that have fibers oriented at an angle that is slightly different from a desired angle. Where manufacturing constraints are an issue and inconsistencies may be likely, actual angles and orientations may differ from the desired angle or orientation by at least plus or minus 5 degrees. For example, when an angle of 15 degrees is desired, the actual angle produced in manufactured composite material bat 100 may be as low as 10 degrees or as high as 20 degrees.

In different embodiments and in different layers, the orientation of fibers may be an angle from 0 to 90 degrees that is approximately a multiple of 15 degrees. In exemplary embodiments shown in FIG. 4, composite material 112 is composed of fibers oriented at an angle $\alpha$ with respect to longitudinal axis A. Angle $\alpha$ is equal to 0 degrees. Composite materials 114, 116, 118, 120, 122, 124, 126, 128, 130, 132, and 134 are composed of fibers oriented at angles $\beta$, $\gamma$, $\epsilon$, $\theta$, $\theta$, $\lambda$, $\mu$, $\rho$, $\phi$, $\Phi$, and $\omega$, respectively, as measured from longitudinal axis A. Angles $\beta$, $\gamma$, $\epsilon$, $\eta$, $\theta$, $\lambda$, $\mu$, $\rho$, $\phi$, $\Phi$, and $\omega$ are approximately +15, −15, +30, −30, +45, −45, +60, −60, +75, −75, and 90 degrees, respectively. Different combinations of these layers may be stacked and shaped to form barrel portion 104.

In different embodiments, the thickness of each layer may vary. The thickness may be a function of the desired material strength balanced by the desired weight. In some embodiments, each layer may be as thick as the diameter of a single fiber of fibers 138. However, in other embodiments, the thickness of each layer may be larger and vary from one layer to another layer.

In forming some embodiments of barrel portion 104 of composite material bat 100, the individual layers having angles with an absolute value between 0 and 90 degrees may be constructed so that a layer having a positive angle is located more interior to a layer having the same angle at negative orientation. In other embodiments, these positive and negative layers may be reversed.

Figure 5:
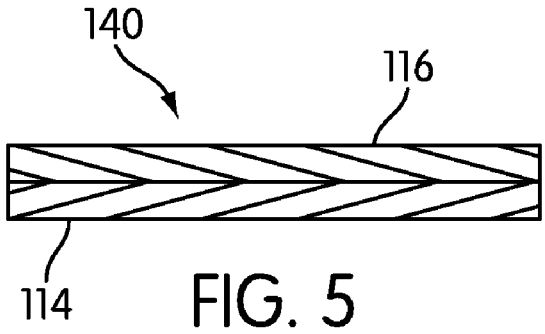
FIG. 5 is a schematic side view of an embodiment of a layered unit having a +/−15 degree angle orientation.
Figure 6:
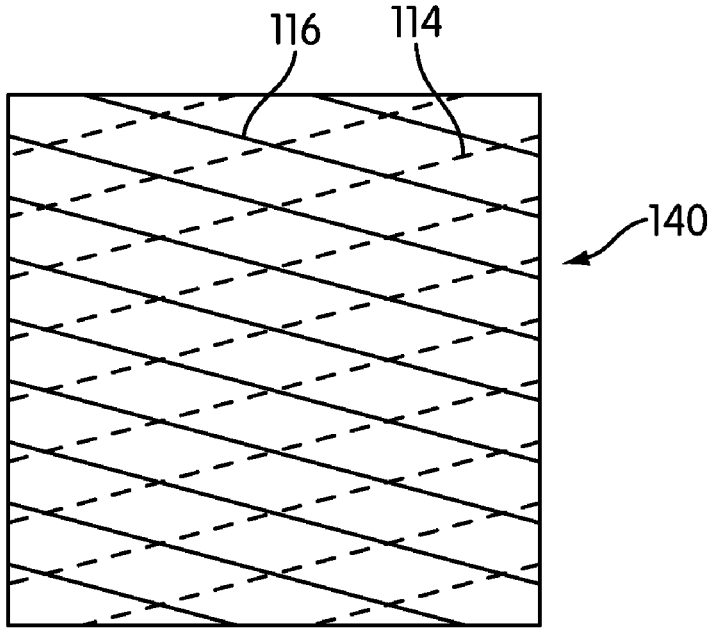
FIG. 6 is a schematic top view of an embodiment shown in FIG. 5.

FIGS. 5 and 6 provide an exemplary embodiment. FIG. 5 is a schematic side view of an embodiment of a layered unit 140 having a +/−15 degree angle orientation. FIG. 6 is a schematic top view of layered unit 140. In a composite material bat according to some embodiments of the invention, a composite layer 114 having a fiber angle of orientation of +15 degrees is paired with a composite layer 116 having a fiber angle of orientation of −15 degrees. In such an example, plus-minus layer combination 140 may be positioned within a composite material bat so that composite layer 114 is more interior than composite layer 116. If plus-minus layer combination 140 were viewed from above composite layer 116, the fibers of composite layer 114 and composite layer 116 would appear to form a weaved pattern. Composites with weaved fibers can typically accommodate loading in different directions. However, weaving fibers may be expensive due to difficulties in weaving, breakage of the fibers, and other manufacturing limitations. Although, plus-minus layer combination 140 is not actually weaved, in operation, a plus-minus layer combination may function similarly to a weaved composite because plus-minus layer combination 140 has multi-directional fibers. In other words, plus-minus layer combination 140 may have greater strength than a layer combination including two layers of composite layer 114, where all of the fibers are substantially parallel to each other.

Figure 7:
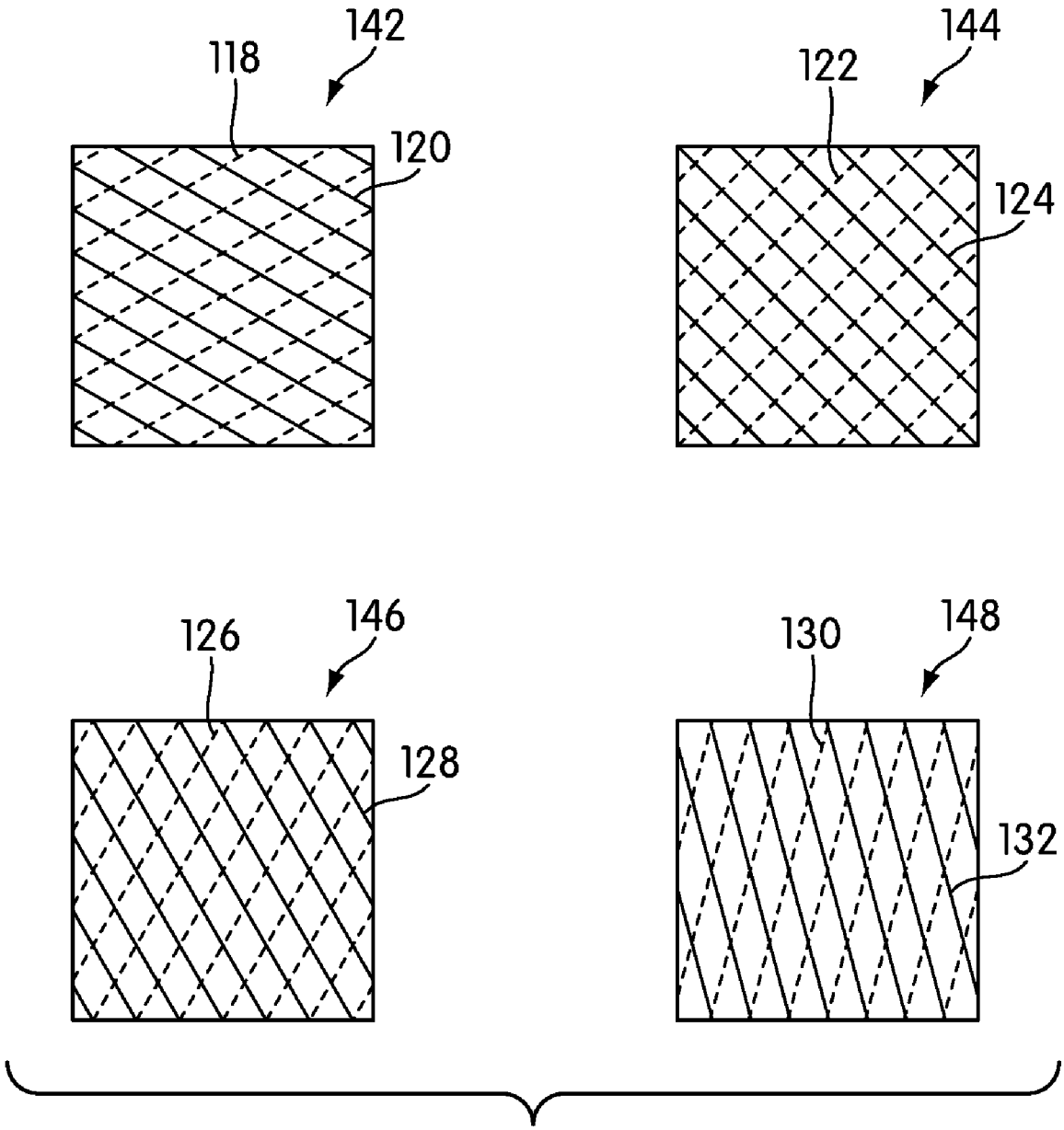
FIG. 7 is a schematic diagram of numerous embodiments of layered units having varying +/−angle orientations.

The weave effect may be enhanced using other angles. FIG. 7 is a schematic diagram of numerous embodiments of plus-minus layer combination having varying angle orientations. Referring to FIG. 7, plus-minus layer combination 142 comprises composite layer 118 having a fiber angle orientation of +30 degrees and composite layer 120 having a fiber angle orientation of −30 degrees. Plus-minus layer combination 144 comprises composite layer 122 having an fiber angle orientation of +45 degrees and composite layer 124 having a fiber angle orientation of −45 degrees. Plus-minus layer combination 146 comprises composite layer 126 having a fiber angle orientation of +60 degrees and composite layer 128 having a fiber angle orientation of −60 degrees. Plus-minus layer combination 148 comprises composite layer 130 having a fiber angle orientation of +75 degrees and composite layer 132 having a fiber angle orientation of −75 degrees.

Composite material bats may be manufactured using any standard manufacturing techniques, such as lay up, filament winding, resin transfer molding, vacuum bagging, or the like. In some embodiments, a lay up technique is used. This technique uses a mandrel as the support for the bat while the layers of the bat are configured. The innermost layer of the bat is laid on top of the mandrel. The mandrel may be coated with a material that allows a completed bat to be removed without damage, such as a spray or release film. Layers are stacked on top of the innermost layer until all the desired layers have been positioned on the mandrel. Once all the layers have been placed on the mandrel, the layer and mandrel assembly are ready to be cured. The curing process involves placing the bat and mandrel assembly within an oven at a temperature that allows the layers of each wall of the bat to bond together. After curing, the mandrel is extracted from the finished barrel portion 104 shell.

Figure 8:
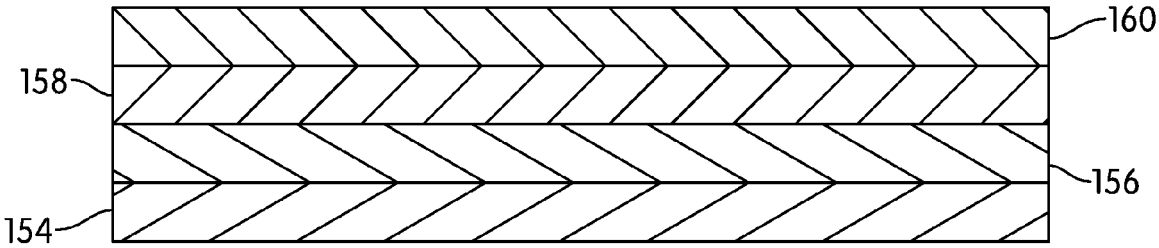
FIG. 8 is a schematic side view of an embodiment of two layered units having +/−30 degree and +/−45 degree fiber angle orientation.
Figure 9:
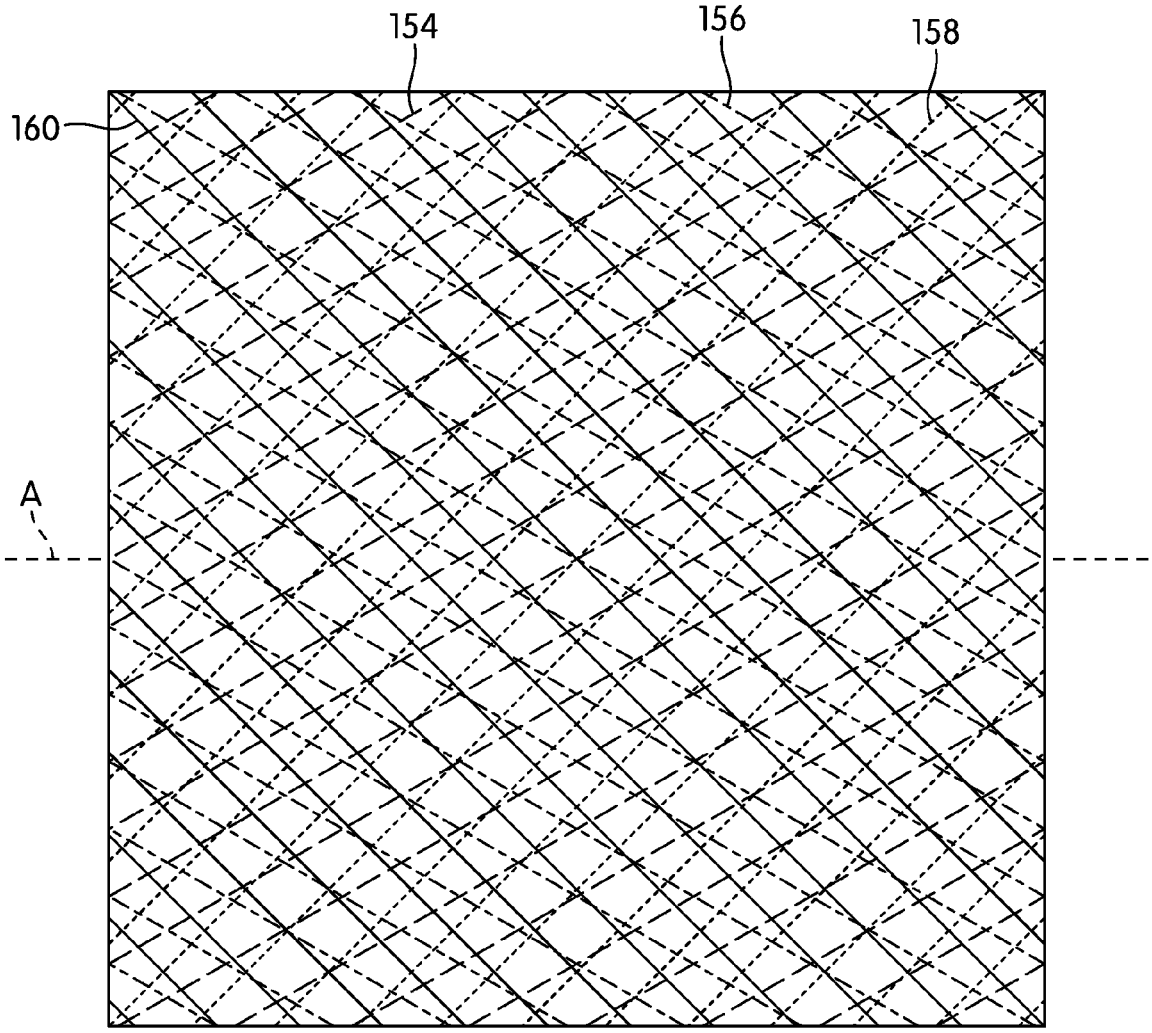
FIG. 9 is a schematic top view of an embodiment shown in FIG. 8.

FIG. 8 is a schematic side view of an embodiment of two layered units having +/−30 degree and +/−45 degree angle orientation. FIG. 9 is a schematic top view of an embodiment shown in FIG. 8. Referring to FIGS. 8 and 9, composite layer 160 having fibers oriented at a −45 degree angle with respect to longitudinal axis A is situated adjacent to and in contact with composite layer 158 having fibers oriented at a +45 degree angle with respect to longitudinal axis A. Composite layer 158 is situated adjacent to and in contact with composite layer 156 having fibers oriented at a −30 degree angle with respect to longitudinal axis A. Composite layer 156 is situated adjacent to and in contact with composite layer 154 having fibers oriented at a +30 degree angle with respect to longitudinal axis A. Stacking layers with differently oriented fibers produces a pseudo-weave pattern. As illustrated in FIG. 9, the tightness of the pseudo-weave pattern increases with the increased number of +/−layer assemblies that are offset by a 15 degree angle with respect to longitudinal axis A. As the pseudo-weave pattern tightens, the toughness and stiffness of composite material bat 100 increases.

Figure 10:
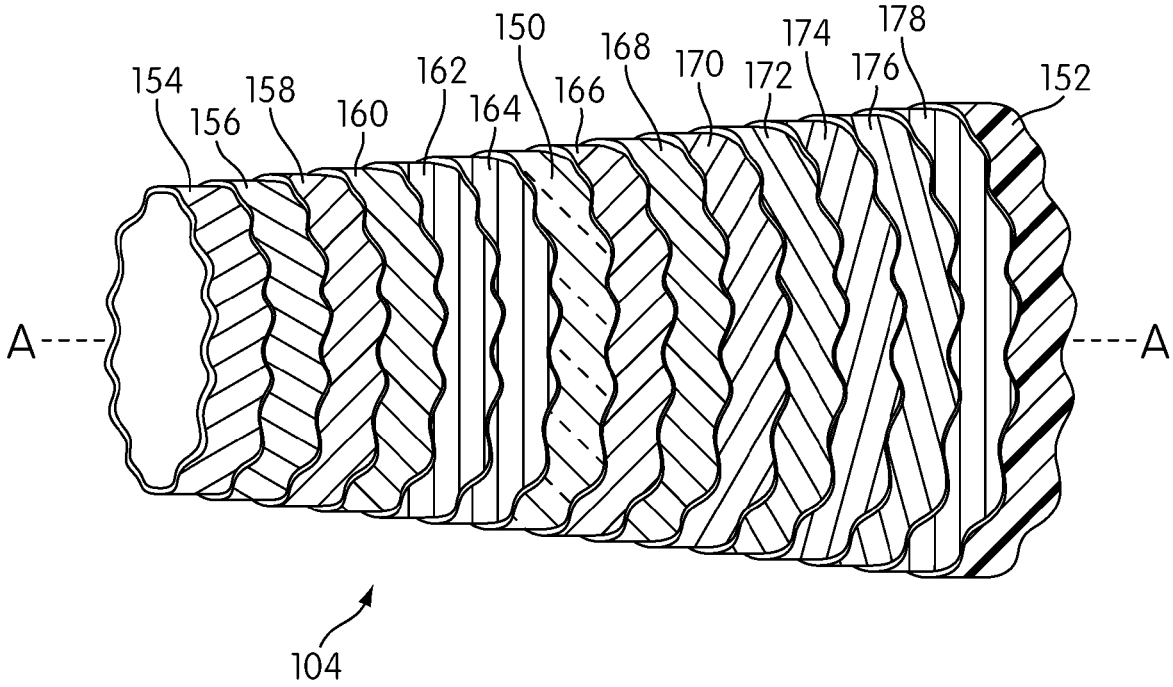
FIG. 10 is a schematic multiple cut away diagram of an embodiment of a barrel portion of a composite material bat.
Figure 11:
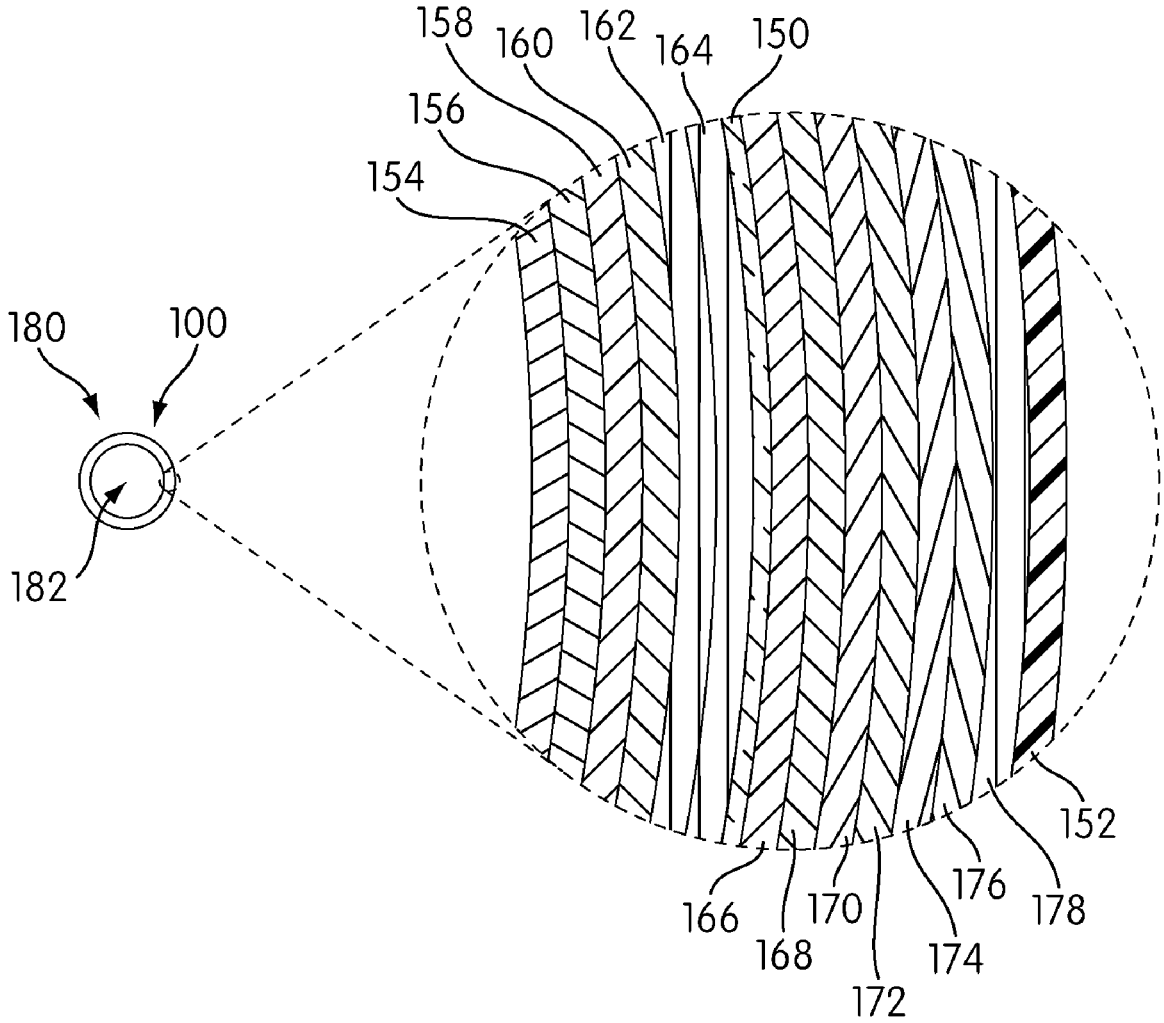
FIG. 11 is a schematic enlarged cross sectional diagram of an embodiment of a barrel portion of a composite material bat.

FIG. 10 is a schematic multiple cut away diagram of an embodiment of a barrel portion 104 of a composite material bat having a plurality of layers of unidirectional fibers, where the angle of the fibers with respect to the longitudinal axis of the bat gradually increases from a low angle on the innermost layer to a high angle on the outer layers. FIG. 11 is a schematic enlarged cross sectional diagram of an embodiment of a barrel portion 104 of a composite material bat 100. FIGS. 10 and 11 illustrate an exemplary embodiment showing ten layers of barrel 104. In other embodiments, the number of layers may vary. It is anticipated that the number of layers may range from about ten (10) layers to about forty (40) layers, although some embodiments may have less than ten (10) or more than forty (40) layers. Referring to FIGS. 10 and 11, listed in Table 1 below are the reference numerals, materials of manufacture, and if applicable, the fiber angle orientation of each of the ten layers in this example embodiment. In other embodiments, the materials, number of layers, and fiber angle orientations may differ.

TABLE 1

Layers and Fiber Angles of First Example

| Reference Numeral | Material | Fiber Angle (degrees) |
|---|---|---|
| 154 | Carbon Fiber/Epoxy Resin Matrix | +30 |
| 156 | Carbon Fiber/Epoxy Resin Matrix | −30 |
| 158 | Carbon Fiber/Epoxy Resin Matrix | +45 |
| 160 | Carbon Fiber/Epoxy Resin Matrix | −45 |
| 162 | Carbon Fiber/Epoxy Resin Matrix | 90 |
| 164 | Carbon Fiber/Epoxy Resin Matrix | 90 |
| 150 | Release Film | N/A |
| 166 | Carbon Fiber/Epoxy Resin Matrix | +45 |
| 168 | Carbon Fiber/Epoxy Resin Matrix | −45 |
| 170 | Carbon Fiber/Epoxy Resin Matrix | +60 |
| 172 | Carbon Fiber/Epoxy Resin Matrix | −60 |
| 174 | Carbon Fiber/Epoxy Resin Matrix | +75 |
| 176 | Carbon Fiber/Epoxy Resin Matrix | −75 |
| 178 | Carbon Fiber/Epoxy Resin Matrix | 90 |
| 152 | Glass Fiber | 90 |

Composite material bat 100 includes numerous layers. The outermost layer, layer 152, defines the composite material bat exterior 180. Outermost layer 152 may be a protective glass fiber layer. In some embodiments, outermost layer 152 may contain a plurality of unidirectional glass fibers having any orientation with respect to the longitudinal axis. For example, the unidirectional glass fibers may be longitudinal fibers, axial fibers, or have any low or high angle. In another embodiment, outermost layer 152 may be fiberglass, having a plurality of chopped fibers positioned at random angles throughout layer 152. In some embodiments, outermost layer 152 may include a coating. The coating in some embodiments may include a decorative or sealant element. The sealant may include any sealant known in the art capable of withstanding moisture, heat, and impacts. The decorative layer may include paint, logo elements such as decals, and/or a clear coat. The innermost layer 154 defines composite material bat interior 182. As illustrated in FIGS. 10 and 11, composite bat interior 182 may be hollow.

The lines indicated in FIG. 10 on layers 154, 156, 158, 160, 162, 164, 166, 168, 170, 172, 174, 176, and 178 schematically reflect the angular orientation of the fibers of these composite materials. The precise number and modulus of the fibers is not necessarily represented in this FIG. Similar lines are shown in FIG. 11 for each layer. However, in FIG. 11 the lines do not represent the direction of fibers as seen from the cross-section. In FIG. 11, the orientation of the lines are used to simplify discussion of FIG. 11.

The composite material bat depicted in FIGS. 10 and 11 is a bat with a double-walled barrel portion 104. Release film layer 150 allows bonded layers 154, 156, 158, 160, 162, and 164 of a first wall to slide and strain with respect to at least a portion of bonded layers 166, 168, 170, 172, 174, 176, 178, and 152 of a second wall. This reduces some of the transfer of force from the exterior layers to the interior layers, which, as discussed above, are more prone to failure from impacts.

As illustrated in FIGS. 10 and 11, the composite material bat having multiple walls may not have walls with an identical number of layers or an identical pattern of layers. Additionally, the angles chosen for the fibers in the layers of a bat may be selected to conform the weight, stiffness, and other characteristics of the bat to the regulations of standards organization. For example, an alternate construction of a barrel portion of a composite bat may include an innermost layer with a low angle that is not substantially parallel to the long axis of the bat. An example of such a construction is shown in Table 2. In other embodiments, the materials, number of layers, or fiber angle orientations may differ.

TABLE 2

Layers and Fiber Angles of Second Example

| Layer Position | Material | Fiber Angle (degrees) |
|---|---|---|
| Innermost | Carbon Fiber/Epoxy Resin Matrix | +/−30 |
| Layer | Carbon Fiber/Epoxy Resin Matrix | +/−30 |
| ↓ | Carbon Fiber/Epoxy Resin Matrix | +/−45 |
| ↓ | Carbon Fiber/Epoxy Resin Matrix | +/−45 |
| | Carbon Fiber/Epoxy Resin Matrix | +/−45 |
| | Carbon Fiber/Epoxy Resin Matrix | +/−45 |
| | Carbon Fiber/Epoxy Resin Matrix | +/−45 |
| | Carbon Fiber/Epoxy Resin Matrix | +/−45 |
| | Carbon Fiber/Epoxy Resin Matrix | +/−45 |
| Outermost | Carbon Fiber/Epoxy Resin Matrix | 90 |
| Layer | Carbon Fiber/Epoxy Resin Matrix | 90 |

As illustrated above, a plus-minus layer combination may be followed by another plus-minus layer combination of the same type, i.e., the same absolute value fiber angle of orientation. For example, a plus-minus 45 degree layer combination may be followed by another plus-minus 45 degree layer combination.

The innermost four layers of composite material bat 100 in the second example embodiment include a layered unit having a plus-minus 30 degree layer combination and a plus-minus 45 degree layer combination. The innermost four layers of the alternative embodiment described above are of a similar arrangement. Having such an arrangement, where the angular difference between the plus-minus layer combinations is 15 degrees, forms a tighter pseudo-weave within composite material bat 100. As discussed above, this tighter pseudo-weave allows for greater impact resistance. Also, the shifting stresses from compressive stresses on the exterior of the bat to tension stresses on the interior of the bat, can be accommodated by the shifting fiber angles.

Other sections of the bat may also be configured to accommodate specific design points. Referring to FIGS. 1 and 2, cap 102 operates to close one end of bat 100. Cap 102 may be made of any material capable of being associated with barrel portion 104, such as metals, plastics, composite materials, or the like. Cap 102 may be manufactured in a number of different ways. In one embodiment, cap 102 may be created by folding over barrel portion first end 105 to close off barrel portion first end 105. In other embodiments, cap 102 may be constructed separately and associated with barrel portion first end 105. In such an embodiment, a portion of cap 102 may be inserted inside barrel portion first end 105. The remainder of cap 102 may reside outside of and adjacent to barrel portion first end 105. In such an embodiment, cap 102 may be pressed against barrel portion first end 105 until cap 102 abuts at least a portion of barrel portion first end 105. Cap 102 is then preferably fixedly attached to barrel portion first end 105 using any method known in the art, such as with an adhesive, with another type of mechanical fastener, or by welding. The association of cap 102 with barrel portion 104 may be achieved either directly or indirectly, for example, when intermediate elements may be inserted between cap 102 and barrel portion 104.

The shape and size of cap 102 may vary in different embodiments. The shape and size of cap 102 may be any shape or size. Preferably, some surface of cap 102 contacts some surface of barrel portion 104 so the two may be attached. It is also preferable that the diameter of cap 102 may not be larger than the diameter of barrel portion 104. In addition, the portion of cap 102 that resides outside of barrel portion 104 may include a rounded or beveled edge. In some embodiments, cap 102 is sized and dimensioned to completely close off the interior of barrel portion 104.

Handle portion 108 may be used by a player to grip composite material bat 100 when a player is receiving pitches or carrying composite material bat 100 from one location to another. In different embodiments, the size and shape of handle portion 108 may vary. The size and shape of handle portion 108 may be any size and shape that allows the user to comfortably grip handle portion 108 and swing composite material bat 100. In some embodiments, handle portion 108 may be cylindrically shaped or have a frustoconical shape. The length of handle portion 108 may be one-third the length L of composite material bat 100 and one-third the diameter of barrel portion first end 105. However, in other embodiments, handle portion 108 may be of any shape or size known in the art.

Handle portion 108 may be made of any material known in the capable of being associated with a composite material layered barrel portion 104. In some embodiments, barrel portion 104 and handle portion 108 may be formed as a single unit. In other embodiments, handle portion 108 may be formed separately from barrel portion 104 and attached to barrel portion 104 using any method known in the art. In one method, handle portion 108 may be configured so that a portion of handle portion 108 may be press fitted or otherwise inserted into the hollow center of barrel portion 104. Handle portion 108 may then be affixed, such as with an adhesive or by welding to barrel portion 104. In other embodiments, handle portion 108 is configured to abut barrel portion 104 so that handle portion 108 may be secured to barrel portion 104 using any method known in the art, such as with an adhesive. The association of handle portion 108 with barrel portion 104 may be achieved either directly or indirectly, for example, when intermediate elements may be inserted between handle portion 108 and barrel portion 104. In some embodiments, barrel portion 104 and handle portion 108 may be a single unit. In other embodiments, the entirety of the bat may be a single unit.

In some embodiments, handle portion 108 may be configured with a high-friction coating or a cushioning coating for a more secure and/or comfortable grip. For example, an elastomeric sleeve may be snugly fitted to handle portion 108. In another embodiment, tape may be removably affixed to handle portion 108.

As cap 102 operates to close one end of bat 100, base 110 operates to close the opposite end of bat 100. Base 110 may be manufactured in a number of different ways. In one embodiment, base 110 may be created by folding over handle portion first end 109 to close off handle portion first end 109. In other embodiments, base 110 may be constructed separately and associated with handle portion first end 109. In such an embodiment, a portion of base 110 may be inserted inside handle portion first end 109. The remainder of base 110 may reside outside of and adjacent to handle portion first end 109. The shape and size of base 110 may vary in different embodiments. Preferably, some surface of base 110 contacts some surface of handle portion 108 so the two may be associated with each other. In some embodiments, the diameter of base 110 may be larger than the diameter of handle portion 108. Preferably, the portion of base 110 that resides outside of handle portion 108 may be disc-shaped. However, the shape and size of base 110 may be any shape or size. The association of base 110 with handle portion 108 may be achieved either directly or indirectly, for example, when intermediate elements may be inserted between base 110 and handle portion 108.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A bat comprising:

a hollow barrel having a first wall and a concentric second wall, wherein the first wall comprises a first group of layers and the second wall comprises a second group of layers;

a first wall innermost layer having unidirectional fibers positioned at a first low angle with respect to the longitudinal axis of the bat;

a first wall outer layer having unidirectional fibers positioned at a first high angle with respect to the longitudinal axis of the bat, wherein the first wall outer layer is positioned concentrically outward of the first wall innermost layer so that the first wall outer layer surrounds the first wall innermost layer;

a first wall series of layers including at least three layers positioned between the first wall innermost layer and the first wall outer layer, wherein each layer in the first wall series of layers includes unidirectional fibers at angles different from the first low angle and the first high angle, and wherein the angles of the unidirectional fibers in any two successive layers of the first wall series progress by about 15 degrees;

a second wall innermost layer having unidirectional fibers positioned at a second low angle with respect to the longitudinal axis of the bat, wherein the second wall innermost layer is positioned concentrically outward of the first wall so that the second wall innermost layer surrounds all of the layers of the first wall, and wherein the second wall innermost layer is separate from the first wall so that the second wall is able to move with respect to the first wall;

a second wall outer layer having unidirectional fibers positioned at a second high angle with respect to the longitudinal axis of the bat, wherein the second wall outer layer is positioned concentrically outward of the second wall innermost layer so that the second wall outer layer surrounds the second wall innermost layer; and a second wall series of layers positioned between the second wall innermost layer and the second wall outer layer, wherein each layer in the second wall series of layers includes unidirectional fibers at angles different from the second low angle and the second high angle, and wherein the angles of the unidirectional fibers in two successive layers of the second wall series progress by about 15 degrees.

2. The bat of claim 1, wherein the first low angle and the second low angle range from about 0 degrees to about 30 degrees.

3. The bat of claim 1, wherein the first high angle and the second high angle range from about 45 to about 90 degrees.

4. The bat of claim 1, wherein the first wall is configured to move with respect to at least a portion of the second wall.

5. The bat of claim 4, wherein a layer of release film is positioned between the first wall and the second wall.

6. The bat of claim 1, wherein the barrel is configured to be associated with a handle.

7. A composite material shell comprising:

an innermost layer including a first plurality of unidirectional fibers oriented at a first angle with respect to a longitudinal axis of the shell;

an exterior layer including a second plurality of unidirectional fibers oriented at a second angle with respect to the longitudinal axis of the shell;

a third layer positioned between the innermost layer and the exterior layer;

the third layer including a third plurality of unidirectional fibers oriented at a third angle with respect to the longitudinal axis of the shell;

a fourth layer positioned between the third layer and the exterior layer;

the fourth layer including a fourth plurality of unidirectional fibers oriented at a fourth angle with respect to the longitudinal axis of the shell;

wherein the innermost layer, the exterior layer, the third layer, and the fourth layer constitute a first wall of the shell;

a second wall that entirely surrounds the first wall, the second wall including a second wall innermost layer having unidirectional fibers positioned at a fifth angle with respect to the longitudinal axis of the bat, wherein the second wall innermost layer is positioned concentrically outward of the first wall so that the second wall innermost layer surrounds all of the layers of the first wall, and wherein the second wall innermost layer is separate from the first wall to impede the transfer of forces from the second wall to the first wall;

a second wall exterior layer having unidirectional fibers positioned at a sixth angle with respect to the longitudinal axis of the bat, wherein the second wall outer layer is positioned concentrically outward of the second wall innermost layer so that the second wall outer layer surrounds the second wall innermost layer;

a fifth layer positioned between the second wall innermost layer and the second wall exterior layer;

the fifth layer including a fifth plurality of unidirectional fibers oriented at a seventh angle with respect to the longitudinal axis of the shell;

a sixth layer positioned between the fifth layer and the second wall exterior layer;

the sixth layer including a sixth plurality of unidirectional fibers oriented at a eighth angle with respect to the longitudinal axis of the shell;

wherein the first angle is a first low angle, the fifth angle is a second low angle, the second angle is a 90 degree angle, and the sixth angle is a 90 degree angle;

wherein the fourth angle is less than the second angle;

wherein the fourth angle is about 15 degrees greater than the third angle;

wherein the eighth angle is less than the sixth angle;

wherein the eighth angle is about 15 degrees greater than the seventh angle; and wherein each fiber of the plurality of fibers in any one layer have has a length substantially similar to the length of that layer.

8. The composite material shell of claim 7, wherein the low angle ranges from about zero degrees to about thirty degrees.

9. The composite material shell of claim 7, further comprising an outermost layer positioned adjacent the second wall exterior layer, the outermost layer comprising chopped fibers.

10. The composite material shell of claim 7, wherein the third angle is about 15 degrees greater than the first angle.

11. The composite material shell of claim 7, wherein the shell is configured to be a barrel portion of a bat.

* * * * *